US008460038B2

(12) United States Patent
Eisert et al.

(10) Patent No.: US 8,460,038 B2
(45) Date of Patent: Jun. 11, 2013

(54) MODULAR TERMINAL AND MODULAR TERMINAL BLOCK

(75) Inventors: Klaus Eisert, Blomberg (DE); Heinz Reibke, Bad Salzuflen (DE); Norbert Hoemann, Brakel (DE); Carsten Pollmann, Steinheim (DE); Dirk Goerlitzer, Hessisch Oldendorf (DE); Harry Bentler, Luegde (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 274 days.

(21) Appl. No.: 12/922,610

(22) PCT Filed: Mar. 12, 2009

(86) PCT No.: PCT/EP2009/001793

§ 371 (c)(1),
(2), (4) Date: Nov. 11, 2010

(87) PCT Pub. No.: WO2009/112265

PCT Pub. Date: Sep. 17, 2009

(65) Prior Publication Data

US 2011/0059658 A1 Mar. 10, 2011

(30) Foreign Application Priority Data

Mar. 14, 2008 (DE) ..... 10 2008 014 177

(51) Int. Cl.
*H01R 9/26* (2006.01)

(52) U.S. Cl.
USPC ..... 439/716

(58) Field of Classification Search
USPC ..... 439/716, 532, 94, 715, 717, 296, 439/507, 709, 711–713, 718, 417, 406; 200/554
See application file for complete search history.

(56) References Cited

U.S. PATENT DOCUMENTS 6,322,399 B1 * 11/2001 Hanning ..... 439/717
6,392,319 B1 * 5/2002 Zebermann et al. ..... 307/147

(Continued)

FOREIGN PATENT DOCUMENTS

DE 197 49 622 C1 2/1999
DE 10 2004 040 859 A1 3/2006

(Continued)

OTHER PUBLICATIONS

Industrielle Verbindungstechnik Markierungssysteme und Montagematerial: Clipline 2007 Catalog, Dec. 31, 2007, p. 334 of Phoenix Contact GmbH & Co. KG.

*Primary Examiner* — Edwin A. Leon
(74) *Attorney, Agent, or Firm* — Roberts Mlotkowski Safran & Cole, P.C.; David S. Safran

(57) ABSTRACT

A modular terminal having a terminal housing, a busbar, and two terminal elements for connecting two conductors to the busbar. Two functional slots are formed at both connecting ends in the terminal housing. The first functional slot provides a first connection possibility for a first test socket or a test plug, and, the second functional slot provides a second connection possibility for a fixed link or a jumper. In order to be able to mount the testing and switching equipment in a simple and flexible manner in the modular terminal, an additional third functional slot is formed at both connecting ends in the terminal housing, a third connection possibility corresponding to the third functional slot is formed at both connecting ends in the busbar, and the connection possibilities in the busbar are openings into which test sockets, test plugs, fixed links, or jumpers can be alternatively plugged.

15 Claims, 12 Drawing Sheets

U.S. PATENT DOCUMENTS

| | | | | |
|---|---|---|---|---|
| 7,192,316 | B1 * | 3/2007 | Pollmann | 439/716 |
| 7,234,961 | B2 * | 6/2007 | Arlitt et al. | 439/410 |
| 7,491,096 | B1 * | 2/2009 | Correll | 439/716 |
| 7,520,776 | B2 * | 4/2009 | Wagener | 439/532 |
| 2011/0014808 | A1 * | 1/2011 | Diessel | 439/296 |

FOREIGN PATENT DOCUMENTS

| | | | |
|---|---|---|---|
| EP | 1 059 691 | A2 | 12/2000 |
| EP | 1 199 774 | A1 | 4/2002 |
| EP | 1 883 132 | A1 | 1/2008 |

* cited by examiner

MODULAR TERMINAL AND MODULAR TERMINAL BLOCK

BACKGROUND OF THE INVENTION

1. Field of the Invention

The invention relates to a modular terminal, especially for locking onto a support rail, with a terminal housing, with a busbar and with at least two terminal elements for connecting at least two conductors to the busbar, on the two connection sides in the terminal housing two functional slots respectively being made and in the busbar corresponding to the first functional slot a first connection possibility for a test socket or a test plug and corresponding to the second functional slot a second connection possibility for a fixed link or a jumper being formed. In addition, the invention relates to a modular terminal block consisting of at least two modular terminals which can be locked next to one another on a support rail.

2. Description of Related Art

Electrical modular terminals have been known for decades and are used in the millions in the wiring of electrical systems and devices. The terminals are generally locked onto support rails which for their part are often located in a plurality in the switching cabinet. The terminal elements in modular terminals are mainly screw-type terminals or tension spring terminals. In addition, however, insulation piercing connecting devices or leg spring terminals can also be used.

The basic type of the modular terminal is the connecting terminal which has at least two terminal elements which are electrically connected to one another via an electrically conductive connecting bar, the busbar. In addition to this basic type, which is often called a feed-through terminal, there is a host of different modular terminal types which are matched especially to the respective application. Examples are protective-conductor terminals, isolating terminals and test terminals.

In particular, various switching, isolating and testing tasks must often be performed in modular terminals which are used in current converter measurement circuits in power generation, transmission and distribution. For this purpose, there are various accessories, such as test sockets, fixed links or jumpers, which can be attached in the modular terminals and can be connected in an electrically conductive manner to the busbar. Using fixed links potential distribution between adjacent modular terminals can be easily accomplished. Jumpers are used to electrically connect two or more adjacent modular terminals to one another as necessary so that there is the possibility of short-circuiting a connected current transformer.

One special modular terminal type which is used especially in current transformer measurement circuits or voltage transformer measurement circuits is the so-called test isolating terminal which is often also called a measurement transformer isolating terminal according to its use. In test isolating terminals the busbar consists of two component pieces which can be selectively connected to one another via a section disconnector or can be isolated from one another.

The modular terminal which underlies the invention is marketed by the assignee under the name test isolating terminal URTK 6 (see, CLIPLINE 2007 catalog, page 334, of Phoenix Contact GmbH & Co. KG). The known modular terminal, on both connection sides in the terminal housing, has two functional slots respectively and corresponding to the functional slots in the two component pieces of the busbar, each has two connection possibilities for a test socket, a test plug, a fixed link or a jumper. The connection of the aforementioned switching and testing accessories to the two component pieces of the busbar takes place by two threaded holes being formed in the component pieces of the busbar and a screw of the respective accessory being able to be screwed into the holes. This ensures secure attachment and good electrical contact-making of the respective accessory in the modular terminal or to the busbar. However, the disadvantage here is that it is relatively time-consuming to screw the respective accessory into the busbar. Moreover, with the test socket screwed in, bridging to adjacent modular terminals is only possible to a limited degree.

SUMMARY OF THE INVENTION

The object of this invention is, therefore, to provide the initially described modular terminal and modular terminal block consisting of several modular terminals in which mounting of the test and switching accessories can take place easily and flexibly. Moreover, the modular terminal will enable a plurality of combinations of the switching and test accessories so that the modular terminal and the modular terminal block can be easily matched to a host of different applications.

This object is ensured in the initially described electrical modular terminal in that a third functional slot in the terminal housing is provided on the two connection sides and in that in the busbar on the two connection sides a third connection possibility corresponding to the third functional slot is arranged. Moreover, the connection possibilities in the busbar are made as openings into which a test socket, a test plug, a fixed link or a jumper can be selectively plugged. By forming a third functional slot and a third connection possibility in the busbar, different bridgings are possible with the test socket plugged in since two functional slots at a time are available on the two connection sides for fixed links or for jumpers.

By forming the corresponding unthreaded, preferably rectangular openings in the busbar, screwless mounting of the test and switching accessories is possible by simply plugging the respective contacts of the accessories into the openings. Preferably, the openings and the contacts of the switching and testing accessories are made and matched to one another such that the test sockets, test plugs, fixed links and jumpers can be locked in the respective openings in the busbar.

According to one advantageous configuration of the modular terminal in accordance with the invention, on the end of the contact of the test socket, a catch hook is formed so that the test socket can be captively locked in an opening in the busbar. This captive locking of a test socket in the modular terminal is especially necessary when the safety test plug of a safety measurement line is to be connected to the test socket. The captive locking of the test socket in the busbar ensures that, when the safety test plug is pulled out of the test socket, the latter is not inadvertently pulled out of the functional slot of the modular terminal, by which there would be the danger that the uninsulated contact of the test socket could be touched by the electrician.

In order to ensure various individual combination possibilities, the functional slots and the openings in the busbar all have the same dimensions. This makes it possible to plug each accessory into each functional slot or into each opening in the busbar. The individual functional slots or the individual openings are thus not assigned to certain types of accessories, for example, only to the bridges or the test sockets. In this way, for an isolating terminal used in a current transformer measurement circuit, for example, a jumper can be plugged into the functional slot for switching the current transformer short circuit on both connection sides, i.e., on either side of the disconnection site.

According to another advantageous configuration of the modular terminal in accordance with the invention, the terminal elements can be made both as leg spring terminals, screw-type terminals and also as tension spring terminals. In this way, the user is enabled to select the connection technology which he prefers. In this case, the terminal housings of the individual modular terminals have essentially identical outside dimensions, regardless of whether the terminal elements are made as leg spring terminals, as screw-type terminals or as tension spring terminals. In particular, the functional slots and the openings in the busbar, regardless of the connecting technology used, are each located at the same position within the terminal housing so that modular terminals which are locked next to one another on a support rail can also be bridged to one another with different terminal elements or can be connected to one another via a jumper.

According to one preferred configuration, the modular terminal in accordance with the invention is a test isolating terminal so that the busbar is formed of two component pieces and a section disconnector is supported to be able to pivot between the two component pieces of the busbar in the terminal housing such that the two component pieces are connected to one another in the first position of the section disconnector and are separated from one another in the second position of the section disconnector. The section disconnector preferably has an isolating blade which is located in the insulating housing and can likewise be plugged and locked in the terminal housing.

In the initially described modular terminal block, the object of the invention is achieved in that three functional slots at a time are formed in the terminal housings of the modular terminals on both connection sides and that, in the busbars of the modular terminals on either connection side, corresponding to the three functional slots three respective openings are formed into which test sockets, test plugs, fixed links or jumpers can be selectively plugged. With respect to the advantages of this execution of the individual modular terminals, reference is made to the above in conjunction with the modular terminal in accordance with the invention.

According to one preferable configuration, the modular terminal block has at least one modular terminal with a continuous busbar, a so-called feed-through terminal, and at least one test isolating terminal. Alternatively or additionally to the feed-through terminal, the modular terminal block can also have a protective-conductor terminal, i.e., a modular terminal in which a busbar with a frame terminal is located. All modular terminals, i.e., the test isolating terminal as well as the feed-through terminal and the protective-conductor terminal have a terminal housing of identical contour with the same width and length. In this way, for example, it is possible, in a modular terminal block for a 3-phase measurement transformer which has six isolating terminals and one protective-conductor terminal, to plug a prefabricated neutral bridge into the functional slots of the corresponding isolating terminals and the protective-conductor terminal, which slots lie on a line; the neutral bridge being directly bridged to the protective-conductor terminal so that the star point of the measurement transformer can be grounded.

According to a last advantageous configuration of the modular terminal block in accordance with the invention which will be briefly explained here, the modular terminal block, in addition, has an insulation plate which is locked on the support rail adjacent to the other modular terminals, in the housing of the insulation plate there being several recesses for accommodating the switching and test accessories, especially plug-in jumpers. The insulation plate thus offers a "parking possibility" for plug-in jumpers so that the jumpers "parked" in the insulation plate are immediately available when the corresponding bridgings are to be undertaken.

In particular, there is now a host of possibilities for embodying and developing the modular terminal in accordance with the invention and the modular terminal block in accordance with the invention. For this purpose reference is made to the following detailed description of preferred exemplary embodiments in conjunction with the accompanying drawings.

BRIEF DESCRIPTION OF THE DRAWINGS

FIG. 5 is a longitudinal sectional view of the modular terminal of FIG. 1 with accessories plugged in.

DETAILED DESCRIPTION OF THE INVENTION

Figure 1:
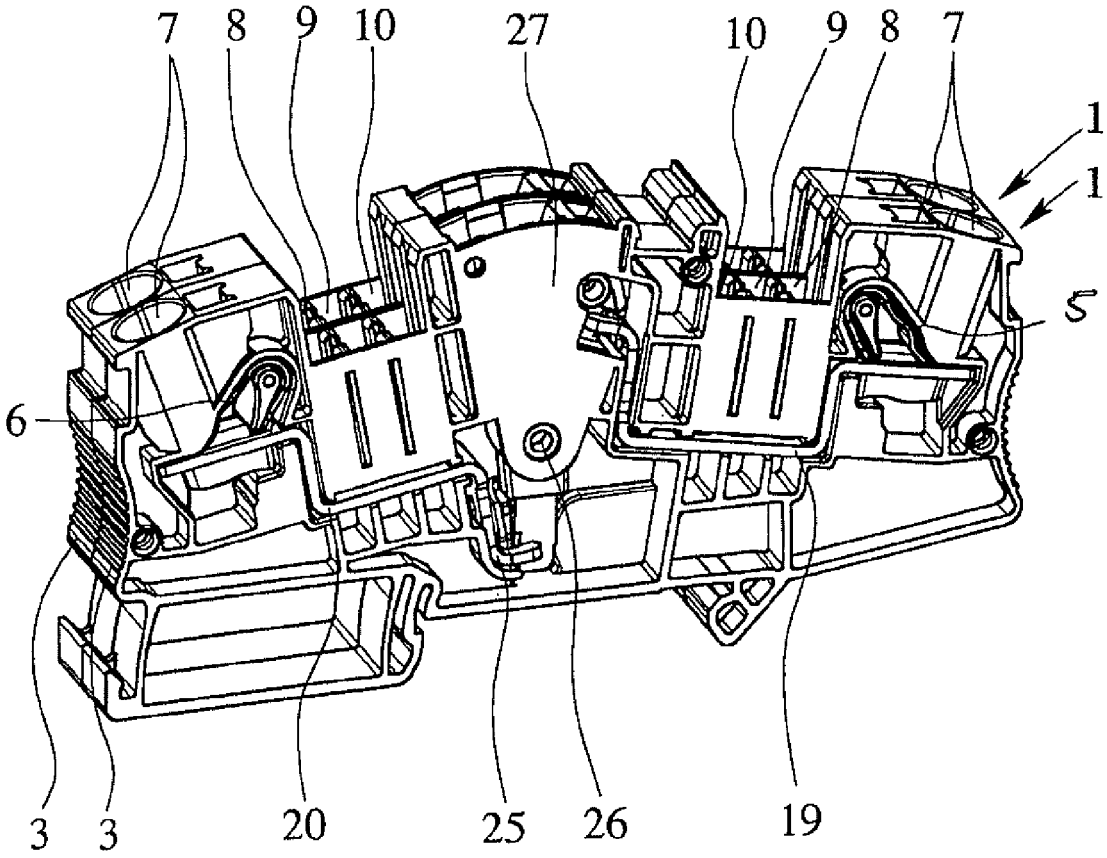
FIG. 1 is a perspective of two adjacent modular terminals in accordance with the invention with leg spring terminals.

FIG. 1 shows two modular terminals 1 in accordance with the invention, each in the form of an isolating terminal, which is used especially as measurement transformer isolating terminal in current transformer measurement circuits of power generation and distribution. The modular terminals 1 can be locked onto a support rail 2 and each have a terminal housing 3 which generally is made of plastic and in which a busbar 4 and two terminal elements 5, 6 are located. The terminal elements 5, 6 in the exemplary embodiment as shown in FIGS. 1 to 6 are made as leg spring terminals into which a respective conductor to be connected can be plugged through a line insertion opening 7 which is made in the terminal housing 2. Moreover, the terminal elements 5, 6 can also be made as tension spring terminals (FIG. 8) or as screw-type terminals (FIG. 9).

Figure 2:
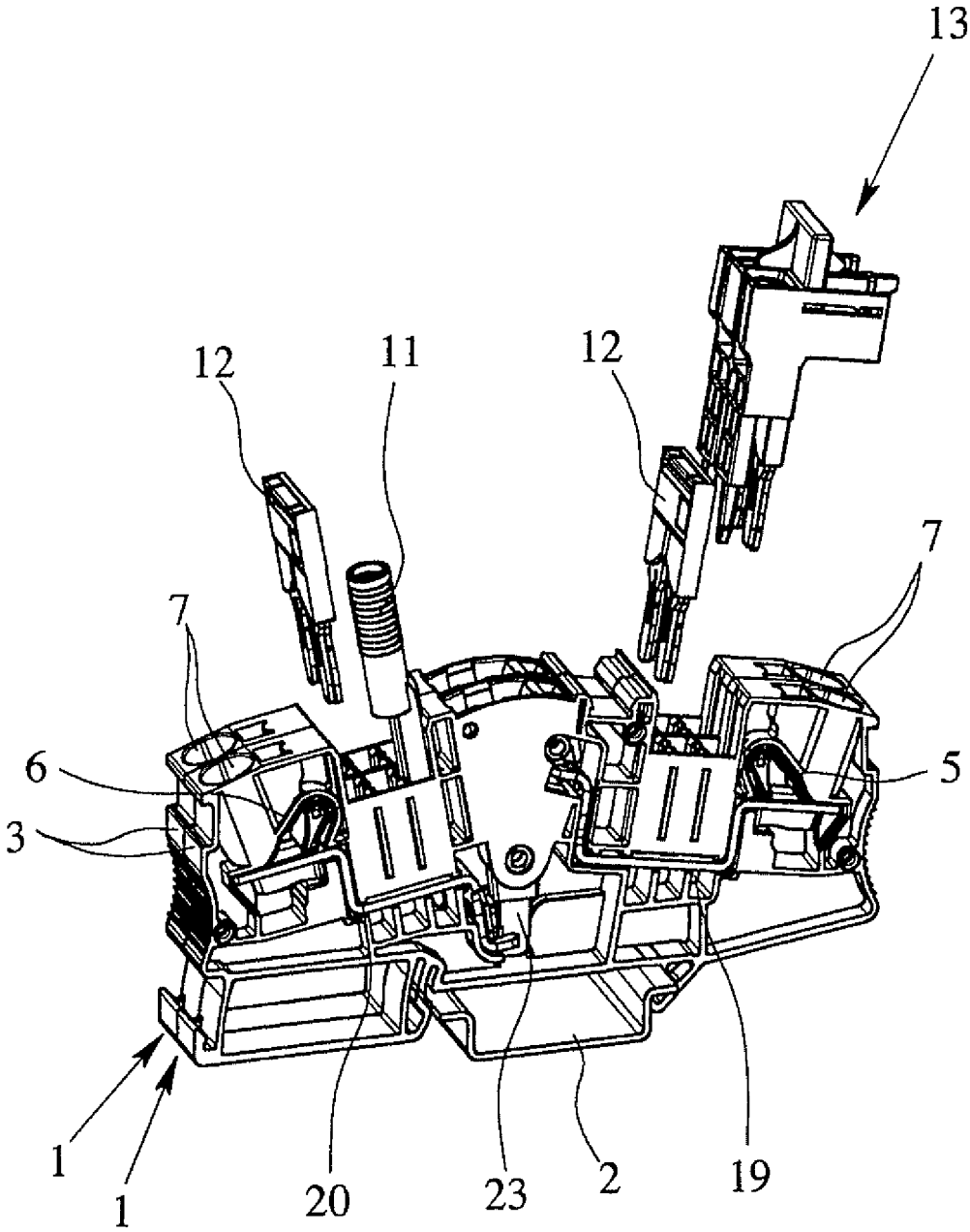
FIG. 2 shows the two modular terminals of FIG. 1, with an inserted test socket, and two fixed links which have not yet been plugged in, and one jumper.
Figure 7:
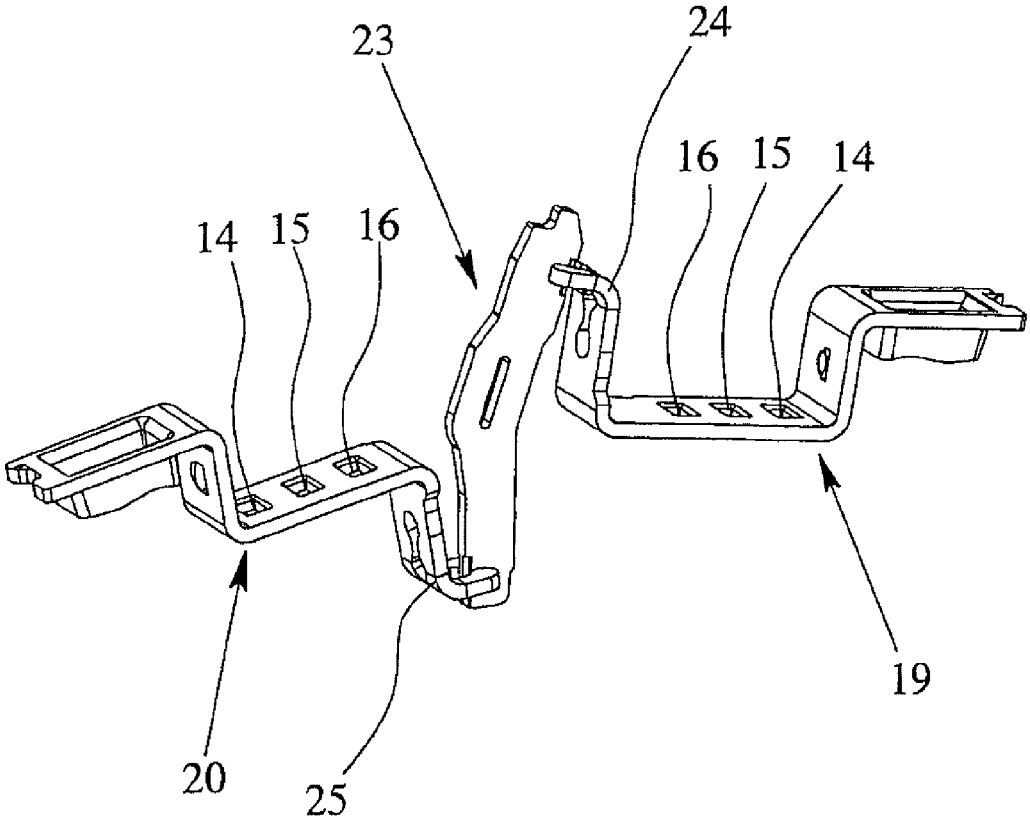
FIG. 7 shows the two component pieces of the busbar of a modular terminal which are electrically connected to one another via an isolating blade.

In the modular terminals 1 shown in the figures, in the terminal housing 3 on both connection sides three functional slots 8, 9, 10 at a time are formed into which the accessories needed for testing, bridging and switching can be plugged. In FIG. 2 they partially include test sockets 11, fixed links 12 for potential distribution and jumpers 13 with which a short circuit between adjacent modular terminals 1 can be reliably and comfortably implemented and which in part have not yet been plugged into the terminal housing 3 of the modular terminals 1. For simple and reliable electrical connection of the test socket 11, the fixed link 12 or the jumper 13, three openings 14, 15, 16 are formed in the busbars 4 of the modular terminals 1 on either connection side (see, FIG. 7) corresponding to the functional slots 8, 9, 10. In this way, the respective accessories can be easily plugged into the respective opening 14, 15, 16 of the busbar 4 from overhead through the functional slots 8, 9, 10.

The contacts of the test socket 11, the fixed link 12 and the jumper 13 are made such that the respective accessories not only make contact electrically with the busbar 4 when plugged into the opening 14, 15, 16, but moreover are also locked in the busbar 4. For this purpose, for example, the contacts of the fixed link 12 and the jumper 13 each have two contact legs arranged parallel to one another, of which at least one is made elastic and has a catch projection.

Figure 6:
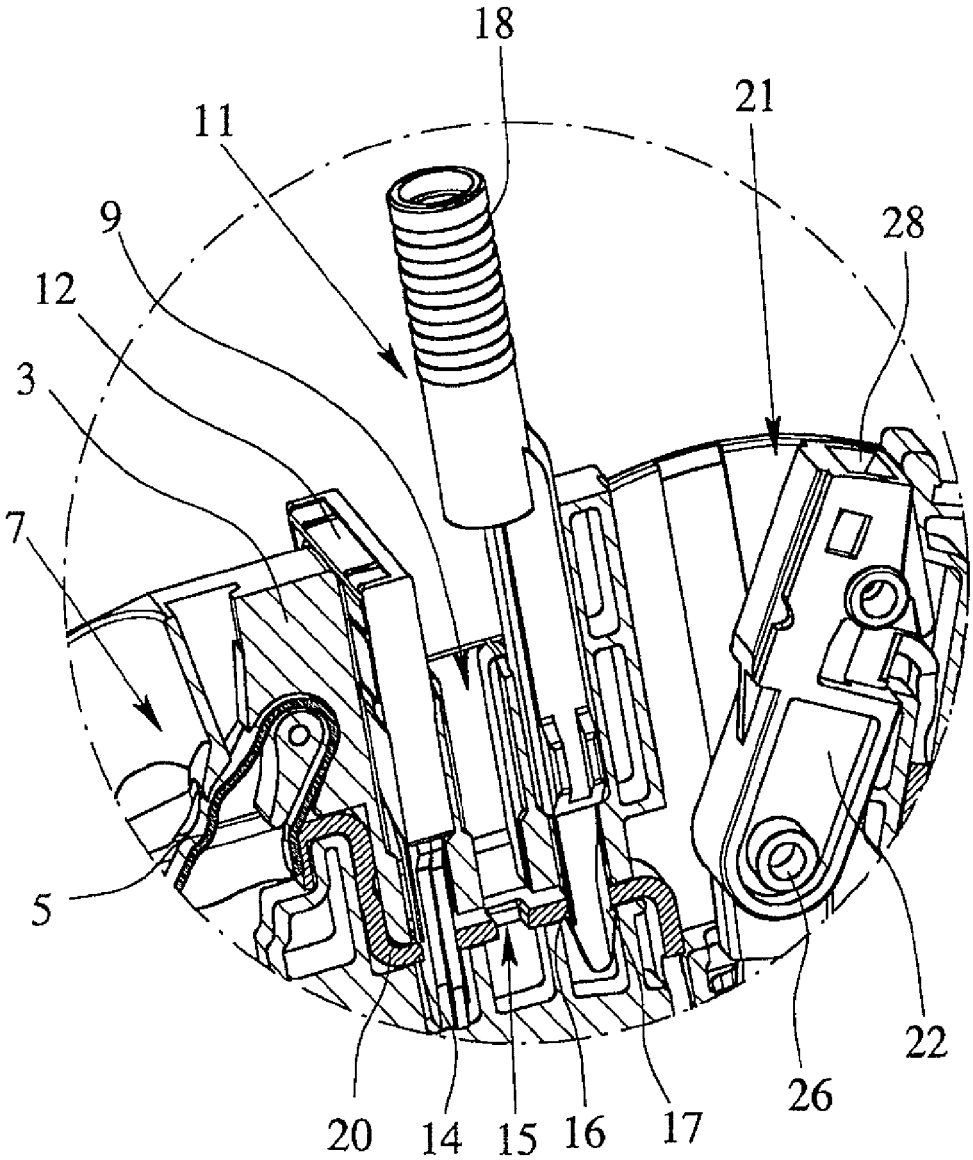
FIG. 6 shows an extract of the modular terminal as shown in FIG. 5.

As the enlargement from FIG. 6 shows, the end of the contact of the test socket 11 has a catch hook 17 so that the test socket 11 can be captively locked in one of the openings 14, 15, 16 in the busbar 4. The test sockets 11 shown in the figures are made such that the corresponding safety test plugs of safety measurement lines can be plugged into their plastic-jacketed sockets 18.

Figure 3:
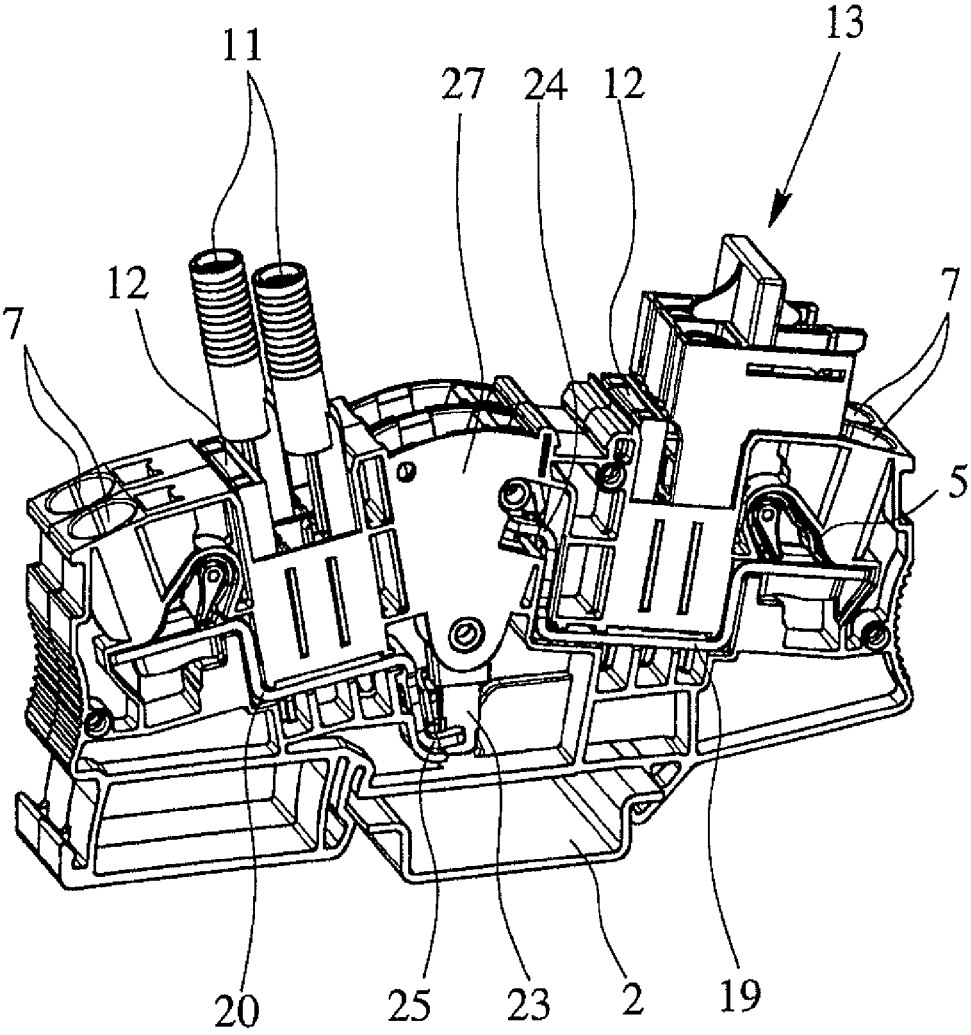
FIG. 3 shows the two modular terminals of FIG. 1, with two test sockets, two fixed links and two jumpers.
Figure 4:
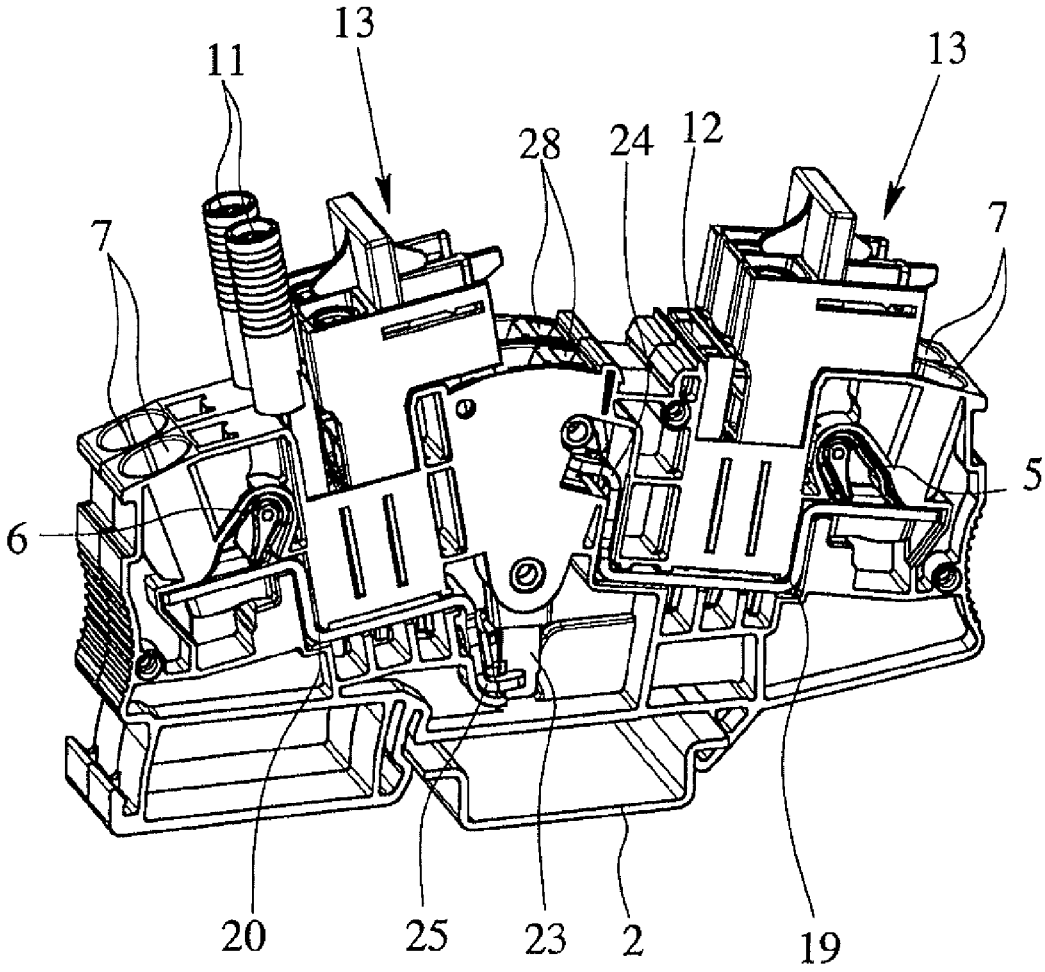
FIG. 4 shows the two modular terminals of FIG. 1, with two test sockets, one fixed link and two jumpers.

A comparison of FIGS. 3 and 4 shows that the accessories can be plugged into any functional slot 8, 9, 10 or into any opening 14, 15, 16 in the busbar 4. The individual functional slots 8, 9, 10, thus, are not dedicated to a certain accessory, so that there is a plurality of individual combination possibilities for plugging in the switching and testing accessories. For example, on each connection side, a respective jumper 13 can be plugged into the functional slots, as is shown in FIG. 4. This is achieved using any of the functional slots 8, 9, 10 and the corresponding openings 14, 15, 16 in the busbar 4, all of which have the same dimensions. Moreover, it is possible to plug the test sockets 11 into the functional slots 8, 9, 10 of the adjacent modular terminal 1 offset relative to one another so that safety test plugs with a diameter of 10 mm can also be plugged into a terminal housing 3 with width of 8 mm.

The modular terminals 1 shown in FIGS. 1 to 8 are so-called isolating terminals in which the busbar 4 is made of two component pieces 19, 20 which can be selectively connected to one another or disconnected from one another by means of a section disconnector 21 which is pivotally mounted in the terminal housing 3. For this purpose, the section disconnector 21 has a blade 23 which is located in the insulating housing 22 and which makes contact in the first position, which is shown in the drawings, with the ends 24, 25 of the component pieces 19, 20 of the busbar 4, which ends face away from the terminal elements 5, 6, so that the two component pieces 19, 20 are connected to one another in an electrically conductive manner by way of the isolating blade 23. In the second position of the isolating blade 23, it does not make contact with either the end 24 of the component piece 19 or the end 25 of the component piece 20 so that the two component pieces 19, 20 are not electrically connected to one another.

Figure 5:
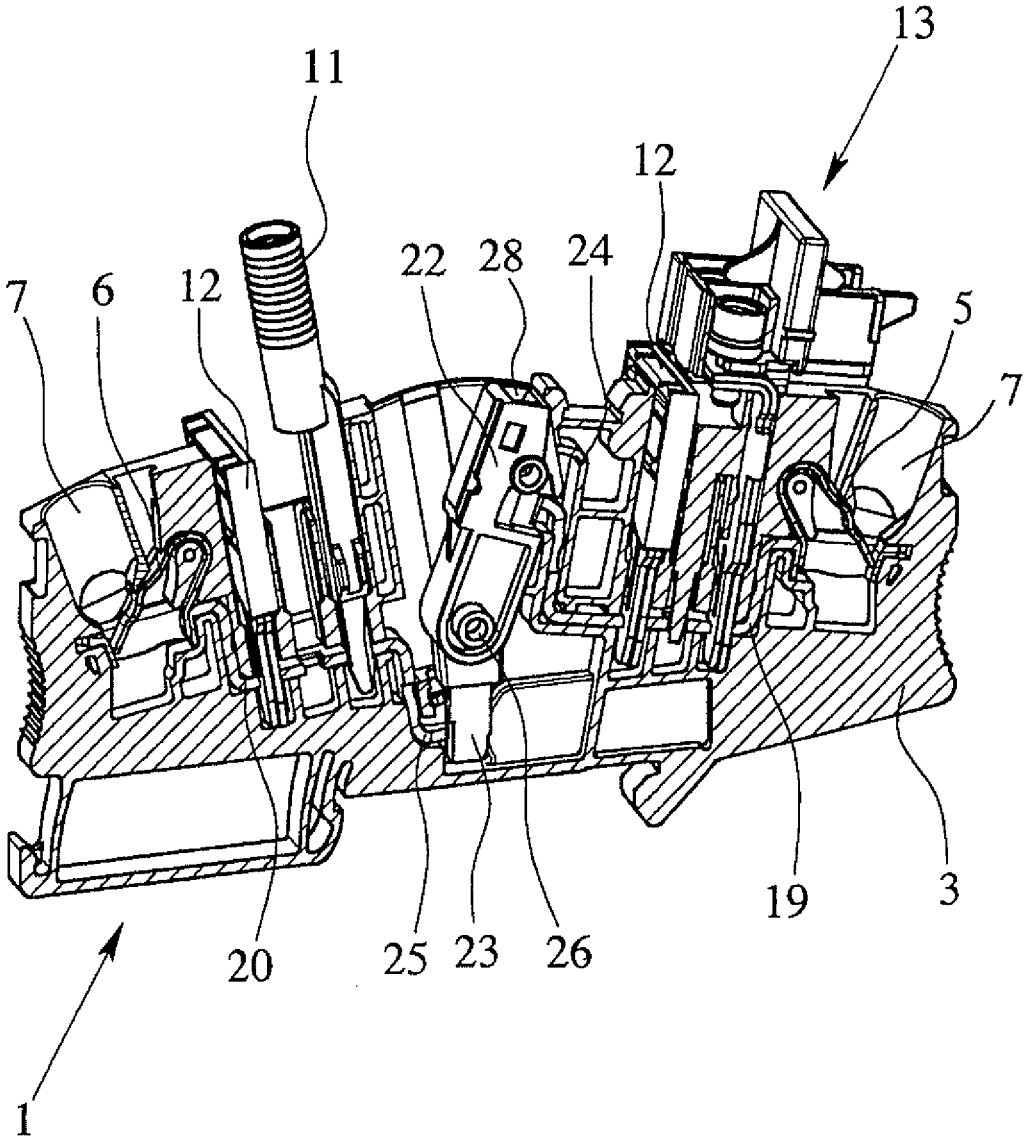

As is apparent from FIGS. 5 and 6, a journal 26 is molded into the insulating housing 22 and is supported in a corresponding opening in the side wall 27 of the terminal housing 3. Moreover, in the upper end of the insulating housing 22, an actuating slot 28 is formed into which a tool, especially the tip of a screwdriver, can be inserted. The actuating slot 28 is dimensioned such that the tip of a screwdriver can be inserted in it and with which the terminal elements 5, 6 can also be actuated. Thus, an additional tool for switching the section disconnector 21 is unnecessary.

Figure 8:
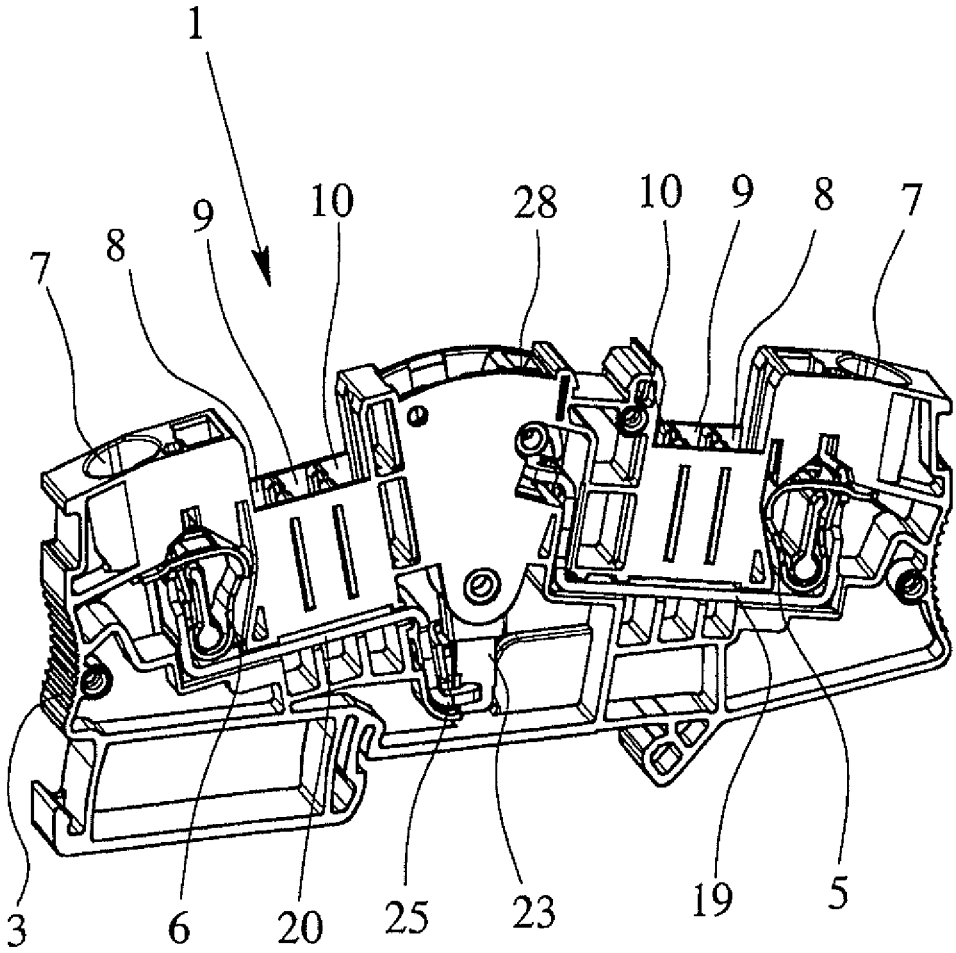
FIG. 8 is a perspective of the modular terminal with tension spring terminals.
Figure 9:
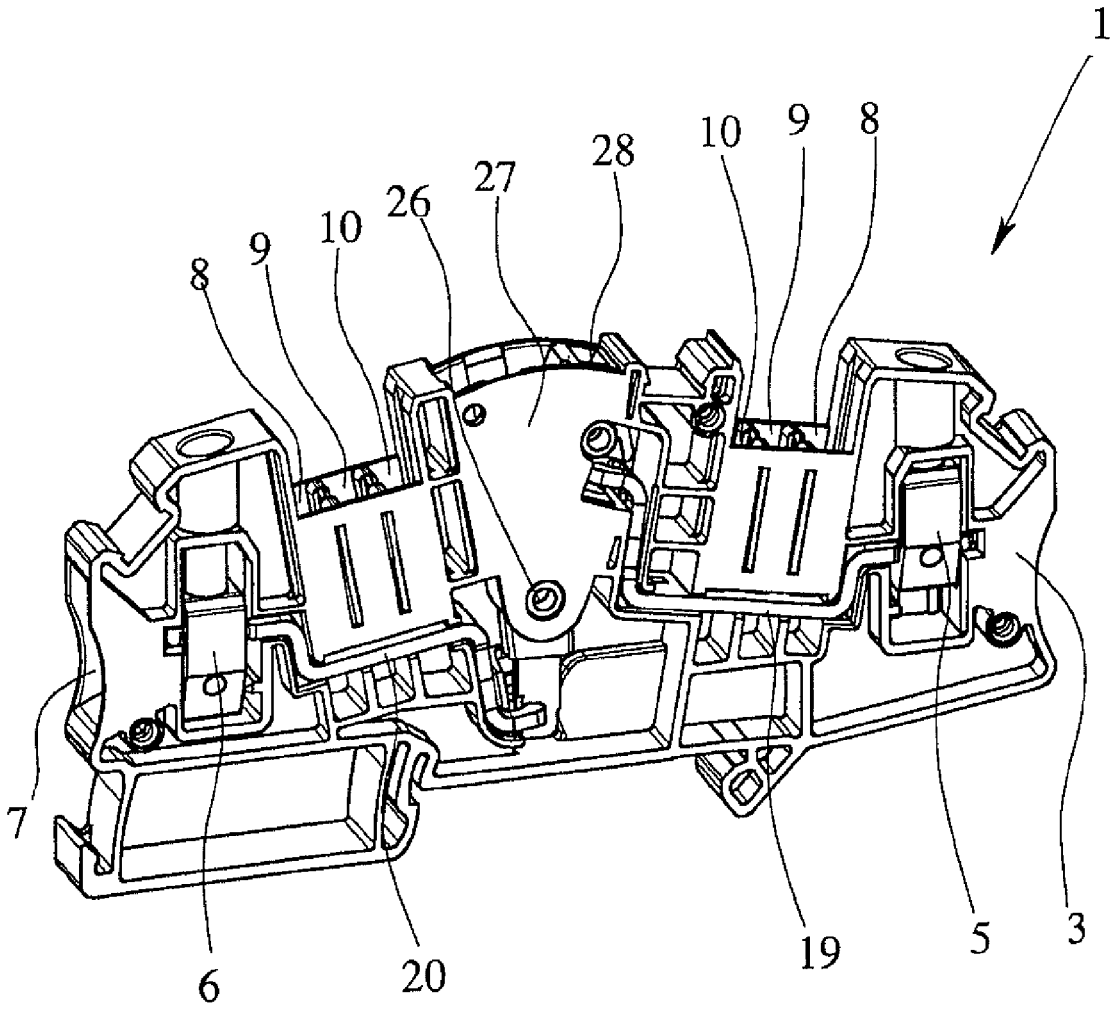
FIG. 9 is a perspective of the modular terminal with screw-type terminals.

While, in the modular terminals 1 as shown in FIGS. 1 to 6, the two terminal elements 5, 6 are made as leg spring terminals, the modular terminal 1 as shown in FIG. 8 has two tension spring terminals as the terminal elements 5, 6 and the modular terminal 1 as shown in FIG. 9 has two screw-type terminals. Therefore, the user has a free choice with respect to the terminal elements 5, 6 to be used. Here, it is important that the terminal housings 3 have essentially the same dimensions, regardless of whether the terminal elements 5, 6 are made as leg spring terminals, as screw-type terminals or as tension spring terminals. In particular, the functional slots 8, 9, 10 and the openings 14, 15, 16 in the busbars 4 for all three modular terminals 1 are located at the same position so that continuous bridging and labeling of modular terminals 1 which have been locked adjacently on a support rail 2 are possible, regardless of which type of terminal elements 5, 6 the modular terminals 1 have.

Figure 10:
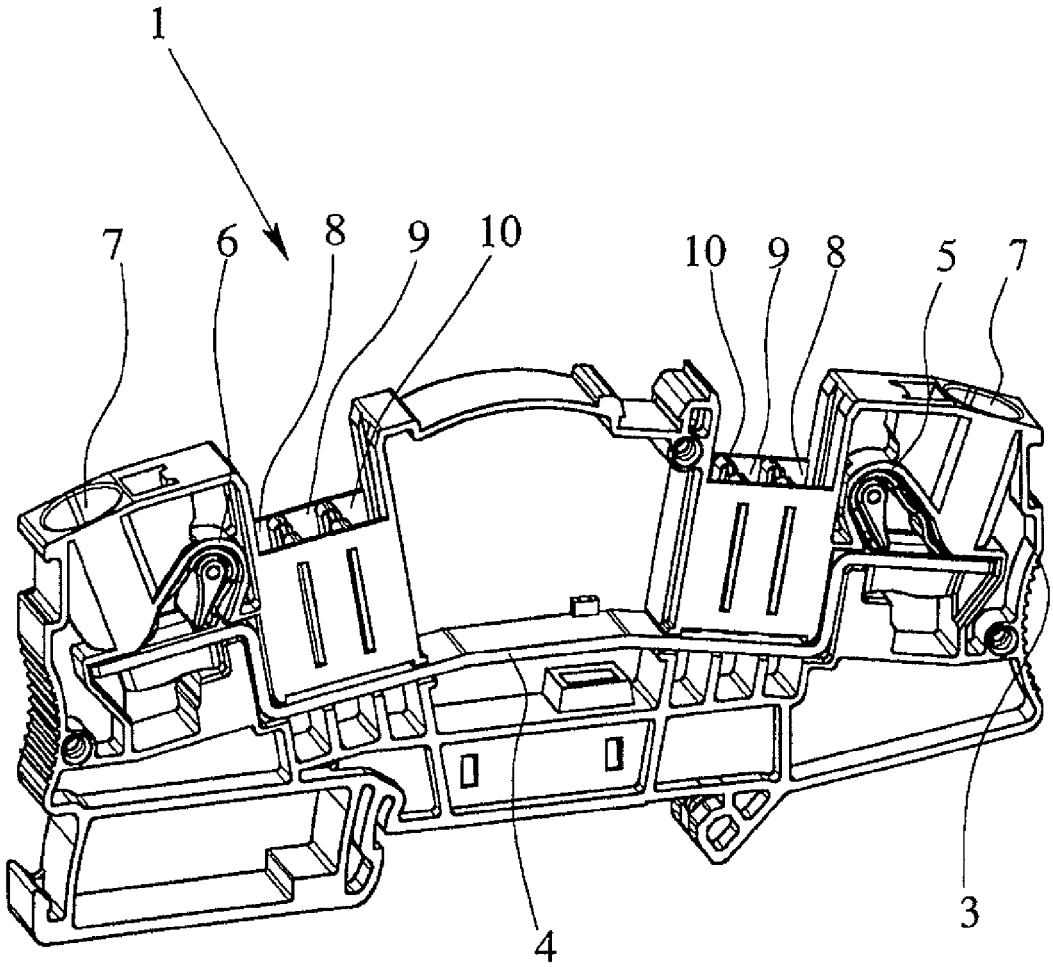
FIG. 10 is a perspective of a modular terminal made as a feed-through terminal.
Figure 11:
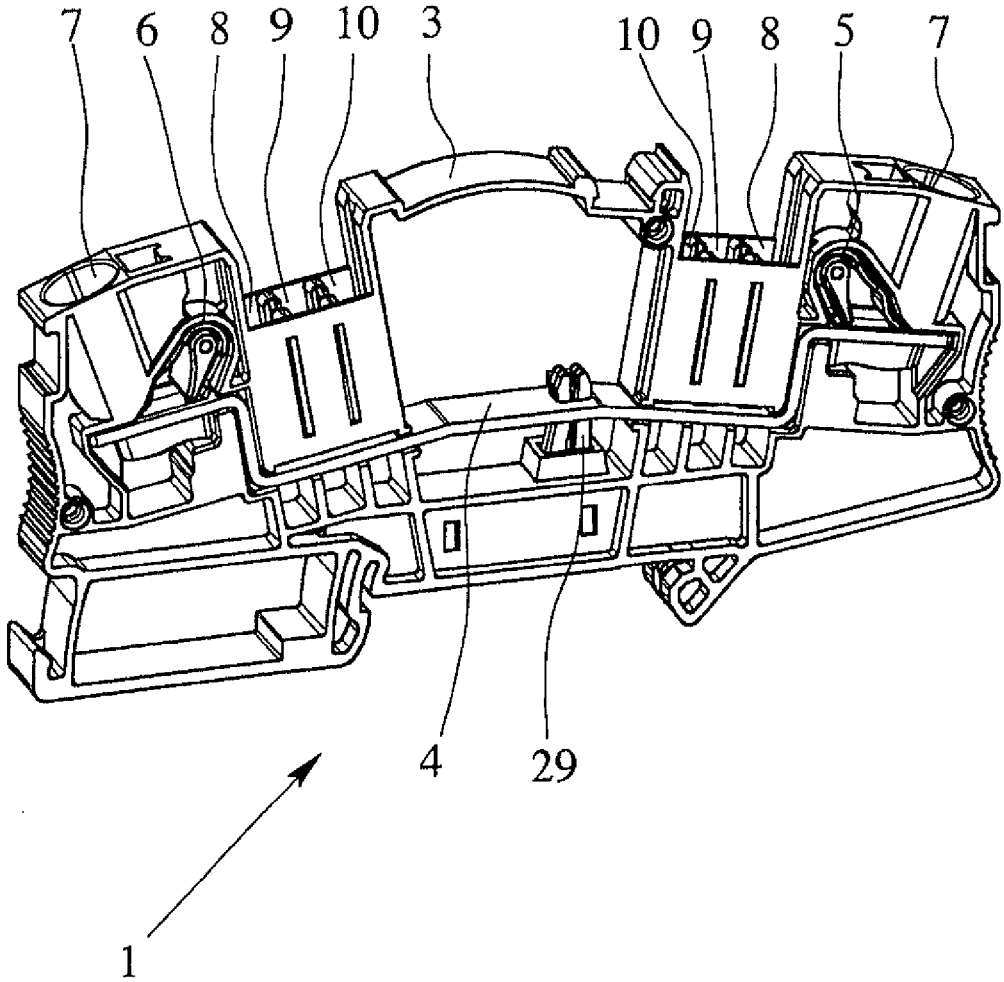
FIG. 11 is a perspective of a modular terminal made as a protective-conductor terminal.
Figure 12:
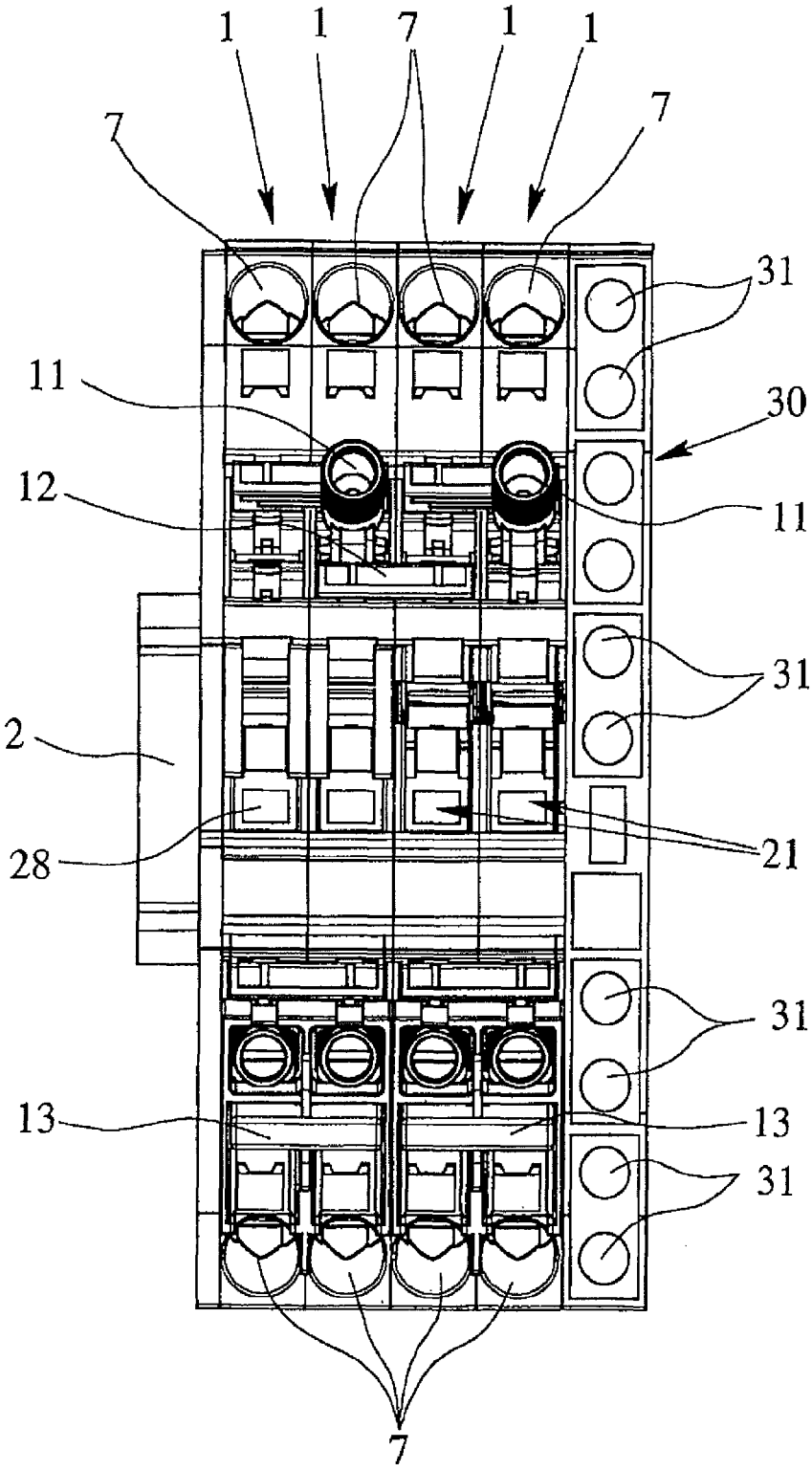
FIG. 12 is a top view of a modular terminal block with several modular terminals and an insulation plate.

While the modular terminals 1 which are shown in FIGS. 1 to 9 are made as isolating terminals, FIG. 10 shows a modular terminal 1 made as a feed-through terminal, i.e., a modular terminal 1 which has a continuous busbar 4. FIG. 11 shows a modular terminal 1 which is made as a protective-conductor terminal. Thus, in this modular terminal 1, there is likewise a continuous busbar 4 in the terminal housing 3, the busbar 4 however being connectable to the support rail 2 via a frame terminal 29. All modular terminals 1, i.e., the isolating terminal as well as the feed-through terminal and the protective-conductor terminal, have a terminal housing 3 of the same contour with identical width and length.

The modular terminal block shown in FIG. 11 is composed of four identical isolating terminals 1 and an insulation plate 30 which is locked on the right side, likewise, onto the support rail 2 and which is made with essentially the same contour as the isolating terminals 1. Moreover, the insulation plate 30 has several recesses 31 into which unneeded accessories, especially unneeded jumpers 12, can be inserted. The insulation plate 30 thus acts as a holding device or parking possibility for jumpers 12 which are temporarily unneeded. FIG. 11 also shows that the individual modular terminal 1 and the insulation plate 30 are made symmetrical to the support rail 2 so that the installation direction of the modular terminals 1 and the insulation plate 30 can be freely selected within the switching system.

What is claimed is:

1. Modular terminal for locking onto a support rail, comprising:

a terminal housing, a busbar, and at least two terminal elements for connecting at least two conductors to the busbar, three functional slots on each of two connection sides of the busbar in the terminal housing, a first of the functional slots corresponds in location to a first connection possibility of the busbar for a test socket or a test plug and a second of the functional slots corresponds in location to a second connection possibility of the busbar for a fixed link or a jumper and a third of the functional slots corresponds in location to a third connection possibility of the busbar, wherein the connection possibilities are made as openings in the busbar into which any one of test sockets, test plugs, fixed links and jumpers can be plugged, wherein the busbar is formed of two component pieces, and wherein a section disconnector is supported to be able to pivot between the two component pieces of the busbar in the terminal housing such that the two component pieces are connected to one another in a first position of the section disconnector and are separated from one another in a second position of the section disconnector.

2. Modular terminal as claimed in claim 1, wherein the any one of test sockets, test plugs, fixed links and jumpers are lockable in the openings in the busbar.

3. Modular terminal as claimed in claim 2, the any one of test sockets, test plugs, fixed links and jumpers comprises a test socket, wherein an end of a contact of the test socket has a catch hook with which the test socket is captively lockable in one of the openings in the busbar.

4. Modular terminal as claimed in one of claim 1, wherein the functional slots and the openings in the busbar all have the same dimensions.

5. Modular terminal as claimed in claim 1, wherein the terminal housing is made symmetrical for locking onto a support rail in either of reversed orientations.

6. Modular terminal as claimed in claim 1, wherein the terminal elements are made as any one of leg spring terminals, screw-type terminals and tension spring terminals.

7. Modular terminal as claimed in claim 6, wherein the terminal housing has the essentially identical outside dimensions and locations of the functional slots and the openings in the busbar regardless of whether the terminal elements are made as leg spring terminals, as screw-type terminals or as tension spring terminals.

8. Modular terminal as claimed in claim 1, wherein the section disconnector has a blade which is located in an insulating housing.

9. Modular terminal as claimed in claim 8, wherein the insulating housing has an actuating slot which is upwardly open and into which a tool insertable.

10. Modular terminal block, comprising:

at least two modular terminals which are lockable next to one another on a support rail, each of the modular terminals having a terminal housing, a busbar and at least two terminal elements for connecting at least two conductors to the busbar, and three functional slots on each of two connection sides of the busbar in the terminal housing, and three openings formed at locations corresponding to the three functional slots on each side of the busbar and into which test any one of sockets, test plugs, fixed links and jumpers can be plugged.

11. Modular terminal block as claimed in claim 10, wherein the terminal housings of the each modular terminal have essentially the same outside dimensions, and locations of the functional slots and the openings in the busbar regardless of whether the terminal elements in the individual modular terminals are made leg spring terminals, screw-type terminals or tension spring terminals.

12. Modular terminal block as claimed in claim 11, wherein the busbar of at least one modular terminal is a continuous busbar and the busbar of at least one modular terminal is formed of two component pieces, wherein a section disconnector is supported to be able to pivot between the two component pieces of the busbar in the terminal housing such that the two component pieces are connected to one another in a first position of the section disconnector and are separated from one another in a second position of the section disconnector, and wherein the section disconnector has an isolating blade which is located in an insulating housing.

13. Modular terminal block as claimed in claim 11, wherein the busbar of at least one modular terminal has a frame terminal and the busbar of at least one modular terminal is formed of two component pieces, wherein a section disconnector is supported to be able to pivot between the two component pieces of the busbar in the terminal housing such that the two component pieces are connected to one another in a first position of the section disconnector and are separated from one another in a second position of the section disconnector, and wherein the section disconnector has an isolating blade which is located in an insulating housing.

14. Modular terminal block as claimed in claim 10, further comprising an insulation plate which has a housing and that is locked adjacent to one of the modular terminals on the support rail, the housing of the insulation plate having several recesses for holding any one of test sockets, test plugs, fixed links and jumpers.

15. Modular terminal block as claimed in claim 14, wherein the insulation plate has essentially the same outside dimensions as the modular terminals and is made symmetrical for mounting to the support rail in either of reversed orientations.

* * * * *